US009354586B2

(12) United States Patent
Oshikawa

(10) Patent No.: US 9,354,586 B2
(45) Date of Patent: May 31, 2016

(54) COMMUNICATION CONNECTOR AND IMAGE FORMING APPARATUS

(71) Applicant: Yuki Oshikawa, Kanagawa (JP)

(72) Inventor: Yuki Oshikawa, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/493,575

(22) Filed: Sep. 23, 2014

(65) Prior Publication Data

US 2015/0118890 A1 Apr. 30, 2015

(30) Foreign Application Priority Data

Oct. 24, 2013 (JP) ..... 2013-221525
Jun. 20, 2014 (JP) ..... 2014-127368

(51) Int. Cl.

| | |
|---|---|
| ***G03G 15/00*** | (2006.01) |
| ***H01R 13/17*** | (2006.01) |
| ***H01R 13/24*** | (2006.01) |
| ***G03G 15/08*** | (2006.01) |
| ***G03G 21/16*** | (2006.01) |

(52) U.S. Cl.

CPC ..... *G03G 15/80* (2013.01); *G03G 15/0863* (2013.01); *G03G 21/1652* (2013.01); *H01R 13/17* (2013.01); *H01R 13/2435* (2013.01); *H01R 2201/06* (2013.01)

(58) Field of Classification Search

CPC . G03G 21/1652; G03G 15/0863; H01R 13/17
USPC ..... 399/90
See application file for complete search history.

(56) References Cited

U.S. PATENT DOCUMENTS

| | | | | |
|---|---|---|---|---|
| 5,964,623 | A * | 10/1999 | Maher | H01R 13/506 439/483 |
| 6,203,147 | B1 * | 3/2001 | Battey et al. | 347/86 |
| D569,342 | S * | 5/2008 | Suzuki | D13/110 |
| D653,216 | S * | 1/2012 | Cheng | D13/144 |
| D730,837 | S * | 6/2015 | Nazar | D13/144 |
| 2003/0215257 | A1 * | 11/2003 | Karakama et al. | 399/90 |
| 2009/0245861 | A1 * | 10/2009 | Eom | 399/119 |
| 2011/0243579 | A1 | 10/2011 | Oshikawa et al. | |

(Continued)

FOREIGN PATENT DOCUMENTS

| | | |
|---|---|---|
| JP | 4843112 | 10/2011 |
| JP | 2012-226288 | 11/2012 |

(Continued)

*Primary Examiner* — David Gray
*Assistant Examiner* — Tyler Hardman
(74) *Attorney, Agent, or Firm* — Oblon, McClelland, Maier & Neustadt, L.L.P.

(57) ABSTRACT

The present invention provides a communication connector arranged on an image-forming apparatus body to provide communications with an information storage device including a guide portion and installed on a detachable device. The connector includes a body terminal which, when the detachable device is attached to the apparatus body, contacts a contact terminal of the information storage device, and a body projection extending in a moving direction of the detachable device and having a slope at its distal end. The body terminal is arranged on the body projection and configured not to project further than the slope, to be exposed to outside from a portion other than the slope, and to contact the contact terminal inside the guide portion when the body projection is inserted thereinto. An inclination angle θ of an end portion of the slope is not smaller than an inclination angle θ1 of the slope.

14 Claims, 12 Drawing Sheets

(56) References Cited

U.S. PATENT DOCUMENTS

| | | | | |
|---|---|---|---|---|
| 2011/0305485 | A1 | 12/2011 | Oshikawa et al. | |
| 2012/0200871 | A1 | 8/2012 | Takahashi et al. | |
| 2013/0188985 | A1 | 7/2013 | Takahashi et al. | |
| 2013/0223877 | A1 | 8/2013 | Takahashi et al. | |
| 2013/0343019 | A1* | 12/2013 | Amann et al. | 361/759 |
| 2014/0029973 | A1 | 1/2014 | Terazawa et al. | |
| 2014/0037325 | A1 | 2/2014 | Takahashi et al. | |
| 2015/0079846 | A1* | 3/2015 | Yang et al. | 439/628 |

FOREIGN PATENT DOCUMENTS

| | | |
|---|---|---|
| JP | 2012-226295 | 11/2012 |
| JP | 2013-113946 | 6/2013 |

* cited by examiner

COMMUNICATION CONNECTOR AND IMAGE FORMING APPARATUS

CROSS-REFERENCE TO RELATED APPLICATIONS

The present application claims priority to and incorporates by reference the entire contents of Japanese Patent Application No. 2013-221525 filed in Japan on Oct. 24, 2013 and Japanese Patent Application No. 2014-127368 filed in Japan on Jun. 20, 2014.

BACKGROUND OF THE INVENTION

1. Field of the Invention

The present invention relates generally to a communication connector configured to communicate with an information storage device installed on a powder container where developer is contained as powder and an image forming apparatus including the communication connector.

2. Description of the Related Art

An image forming apparatus such as a printer, a facsimile, a copier, and a multifunction peripheral having a plurality of functions of these machines typically includes a detachable device detachably mounted on a main body of an image forming apparatus (hereinafter, "image-forming apparatus body"). Examples of the detachable device include a developer container (a toner bottle, a toner container, an ink cartridge). The detachable device may include an information storage device (an information recording unit, a non-volatile memory) implemented in an IC (integrated circuit) chip or the like where various types of information is stored. Mounting the detachable device on the image-forming apparatus body brings a contact terminal included in the information storage device into contact with a terminal (body terminal) of a communication connector mounted on the image-forming apparatus body, thereby enabling to communicate between the information storage device and the communication connector possible. In this state, the communication connector reads out various types of information from the information storage device.

Japanese Patent No. 4843112 proposes a detachable device including an information storage unit which stores information communicated between an image-forming apparatus body and the detachable device, a terminal which is to be brought into contact with a body terminal mounted on the image-forming apparatus body to communicate information with the image-forming apparatus body, an information storage device including a substrate where the information storage unit and the terminal are held and a guide portion to be engaged by a body projection on the image-forming apparatus body is formed, and a holder which holds the substrate of the information storage device in a manner that, when the detachable device approaches the body terminal mounted on the image-forming apparatus body in a moving direction, allows the substrate to move on an imaginary plane intersecting the moving direction.

According to Japanese Patent No. 4843112, the substrate of the information storage device is held by the holder of the detachable device in the manner that allows the substrate to move on the imaginary plane intersecting the moving direction of the detachable device. Accordingly, during attachment of the detachable device on the image-forming apparatus body, the substrate moves with its guide portion guided by the body projection. However, if the body terminal projects out from a tapered distal end (slope) of the body projection, the body terminal can contact and be pushed by the guide portion of the substrate that moves with its guide portion guided by the body projection, possibly resulting in deformation of the body terminal. Such deformation of the body terminal can be a cause of a contact failure between the body terminal and a contact on the IC chip, and therefore can be a cause of a communication error.

Hence, there is a need for a technique which prevents deformation of a body terminal which can occur when a substrate of an information storage device moves with its guide portion guided by the body terminal, thereby attaining a stable communication state with neither contact failure nor communication error.

SUMMARY OF THE INVENTION

It is an object of the present invention to at least partially solve the problems in the conventional technology.

The present invention provides a communication connector arranged on an image-forming apparatus body to make communications with an information storage device including a guide portion and installed on a detachable device possible, the communication connector including: a body terminal configured to, when the detachable device is attached to the image-forming apparatus body, contact a contact terminal of the information storage device; and a body projection extending in a moving direction of the detachable device, having a distal end formed as a conical surface, and being insertable into the guide portion. The body terminal is mounted on the body projection and configured not to project further than the conical surface, to be exposed to outside from a portion other than the conical surface, and to contact the contact terminal mounted inside the guide portion when the body projection is inserted into the guide portion, and the body terminal is configured to satisfy following relationship: $\theta \geq \theta 1$, where $\theta$ is an angle between a tangent extending through an end portion of the body terminal on a side of the conical surface and a center line of the body projection and $\theta 1$ is an angle between the conical surface and the center line.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
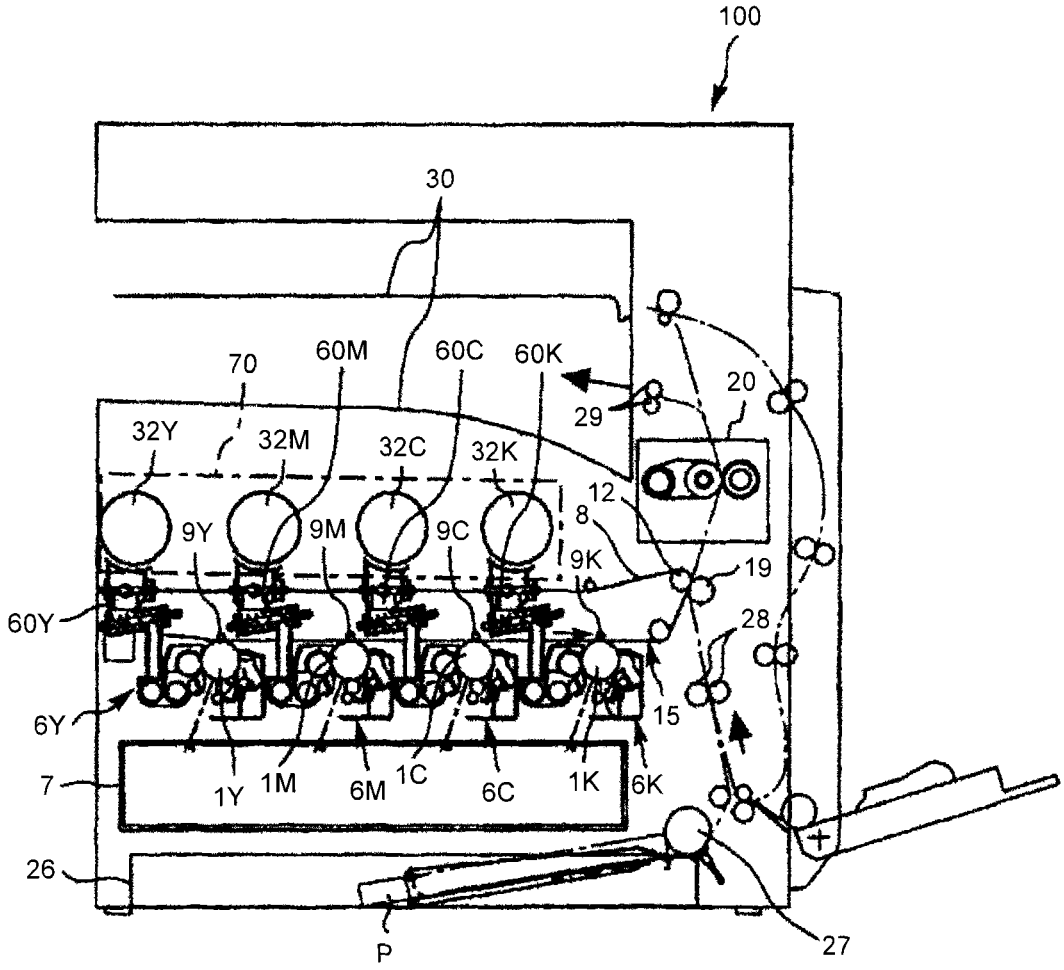
FIG. 1 is an overall configuration diagram illustrating an image forming apparatus according to an embodiment of the present invention.

Modes (hereinafter, referred to as "embodiments") for implementing the invention are described in detail below with reference to the accompanying drawings. Identical or corresponding elements are denoted by same reference numerals in the drawings, and description thereof is simplified or omitted as appropriate. Each of Y, M, C, and K is a suffix appended to elements for a corresponding one of colors (yellow (Y), magenta (M), cyan (C), and black (K)) and omitted as appropriate.

An overall structure and operations of an image forming apparatus are described below.

An image forming apparatus illustrated in FIG. 1 is a copier capable of forming full-color images using developer of yellow, magenta, cyan, and black. A toner container housing 70 is arranged in an upper portion of an image-forming apparatus body 100. Toner containers 32Y, 32M, 32C, and 32K which are four detachable devices for yellow, magenta, cyan, and black are detachably (replaceably) mounted on the toner container housing 70. The image forming apparatus is not limited to a copier, but may be a printer, a facsimile, a multifunction peripheral having a plurality of functions of these machines, or the like.

An intermediate transfer unit 15 is arranged below the toner container housing 70. The intermediate transfer unit 15 includes an intermediate transfer belt 8 as an intermediate transfer member. Image formation units 6Y, 6M, 6C, and 6K for the respective colors (yellow, magenta, cyan, and black) are arranged in a row to face the intermediate transfer belt 8. Toner supply devices 60Y, 60M, 60C, and 60K are arranged below the toner containers 32Y, 32M, 32C, and 32K, respectively. Toner, which is a component of the developer, stored in the toner containers 32Y, 32M, 32C, and 32K is supplied (replenished) by the toner supply devices 60Y, 60M, 60C, and 60K into developing devices of the image formation units 6Y, 6M, 6C, and 6K.

The image formation unit 6Y for yellow is described below with reference to FIG. 2. The image formation unit 6Y includes a photoconductive drum 1Y serving as an image bearer and further includes a charging unit 4Y, a developing device 5Y (developing unit), a cleaning unit 2Y, and a neutralizing unit (not shown) arranged around the photoconductive drum 1Y. The image formation unit 6Y performs an image formation process (including a charging process, an exposure process, a developing process, a transfer process, and a cleaning process) on the photoconductive drum 1Y to thereby form a yellow image on the photoconductive drum 1Y.

Each of the other three image formation units 6M, 6C, and 6K is similar in structure to the image formation unit 6Y for yellow except only the color of the toner, and forms an image of the corresponding toner color. Hereinafter, description about the other three image formation units 6M, 6C, and 6K is omitted as appropriate, and only the image formation unit 6Y for yellow is described below.

Figure 2:
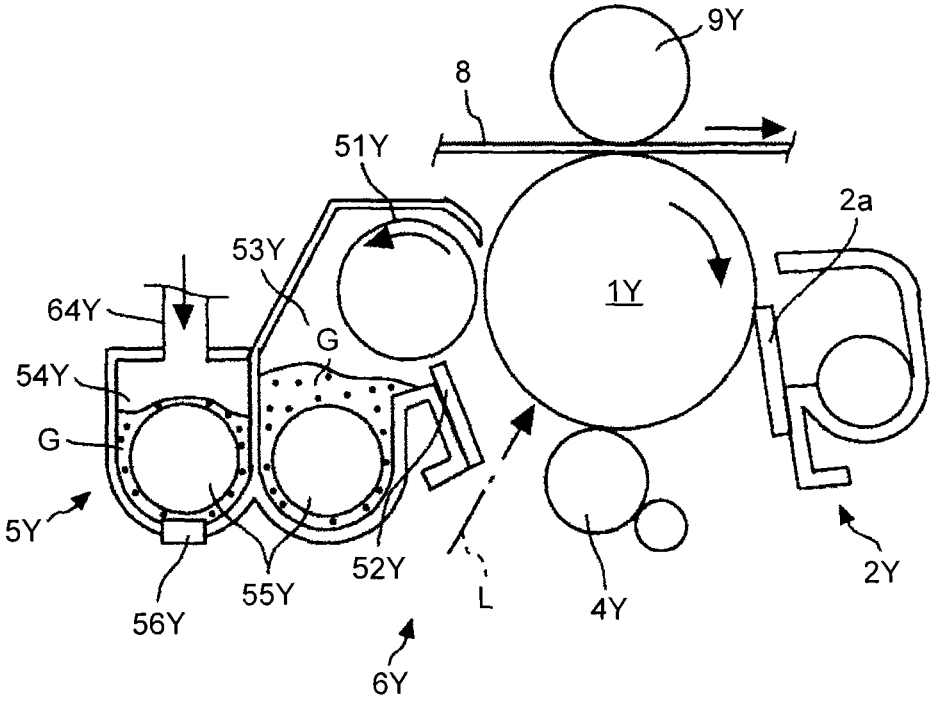
FIG. 2 is a cross-sectional view illustrating an image formation unit of the image forming apparatus illustrated in FIG. 1.

Referring to FIG. 2, the photoconductive drum 1Y is driven to rotate clockwise in FIG. 2 by a drive motor (not shown). The surface of the photoconductive drum 1Y is uniformly charged at a position of the charging unit 4Y (i.e., the charging process is performed). The surface of the photoconductive drum 1Y reaches a position where the surface is irradiated with laser light L emitted from an exposure unit 7 (as can be seen in FIG. 1). At this position, an electrostatic latent image for yellow is formed by scanning exposure (i.e., the exposure process is performed).

The surface of the photoconductive drum 1Y reaches a position where the surface faces the developing device 5Y. At this position, the electrostatic latent image is developed and a yellow toner image is formed (i.e., the developing process is performed). The surface of the photoconductive drum 1Y reaches a position where the intermediate transfer belt 8 and a primary-transfer bias roller 9Y face each other. At this position, the toner image on the photoconductive drum 1Y is transferred onto the intermediate transfer belt 8 (i.e., a primary transfer process is performed). After the primary transfer process, a slight amount of not-transferred toner is left on the photoconductive drum 1Y.

Thereafter, the surface of the photoconductive drum 1Y reaches a position where the surface faces the cleaning unit 2Y. At this position, the not-transferred toner left on the photoconductive drum 1Y is mechanically collected by a cleaning blade 2*a* (i.e., the cleaning process is performed). Finally, the surface of the photoconductive drum 1Y reaches a position where the surface faces the neutralizing unit (not shown). At this position, residual potential on the photoconductive drum 1Y is removed. Hence, the series of image formation process performed on the photoconductive drum 1Y is completed.

Each of the other image formation units 6M, 6C, and 6K also performs the image formation process described above as does the image formation unit 6Y for yellow as follows. The exposure unit 7 arranged below the image formation units irradiates each of the photoconductive drums of the image formation units 6M, 6C, and 6K with the laser light L in accordance with image information. More specifically, the exposure unit 7 causes a light source to emit the laser light L and causes the laser light L to be reflected off from a polygon mirror, which is driven to rotate, so that the laser light L irradiates the photoconductive drums while scanning the same via a plurality of optical elements. Thereafter, the toner images of the respective colors formed on the photoconductive drums through the developing process are transferred onto the intermediate transfer belt 8 to be overlaid on one after another. Consequently, a full-color image is formed on the intermediate transfer belt 8.

Referring to FIG. 1, the intermediate transfer unit 15 includes the intermediate transfer belt 8, the four primary-transfer bias rollers denoted by 9Y, 9M, 9C, and 9K, a secondary-transfer backup roller 12, a plurality of support rollers, and an intermediate-transfer cleaning unit. The intermediate transfer belt 8 is supported in a stretched manner by and around the plurality of support rollers and moved to revolve counterclockwise in FIG. 1 by the secondary-transfer backup roller 12 that is driven to rotate.

Primary transfer nips are formed between the four primary-transfer bias rollers denoted by 9Y, 9M, 9C, and 9K and the photoconductive drums 1Y, 1M, 1C, and 1K, respectively, with the intermediate transfer belt 8 interposed therebetween. A transfer bias whose polarity is opposite to that of the toner is applied to the primary-transfer bias rollers 9Y, 9M, 9C, and 9K. The intermediate transfer belt 8 revolves counterclockwise and passes through the primary transfer nips of the primary-transfer bias rollers 9Y, 9M, 9C, and 9K one by one. The toner images of the respective colors formed on the photoconductive drums 1Y, 1M, 1C, and 1K are thus transferred, as primary transfer, onto the intermediate transfer belt 8 and overlaid on one after another.

Thereafter, the intermediate transfer belt 8 onto which the toner images of the respective colors are transferred while being overlaid on one after another reaches a position where the intermediate transfer belt 8 faces a secondary transfer roller 19. At this position, a secondary transfer nip is formed between the secondary-transfer backup roller 12 and the secondary transfer roller 19 with the intermediate transfer belt 8 interposed therebetween. The four-color toner images formed on the intermediate transfer belt 8 are transferred onto a recording medium P, such as transfer paper, conveyed to this secondary transfer nip position. At this time, not-transferred toner having not been transferred onto the recording medium P is left on the intermediate transfer belt 8. The intermediate transfer belt 8 then reaches the intermediate-transfer cleaning unit (not shown). At this position, the not-transferred toner on the intermediate transfer belt 8 is collected. The series of transfer process performed on the intermediate transfer belt 8 is thus completed.

Meanwhile, the recording medium P has been conveyed to the secondary transfer nip position from a sheet feeding unit 26 arranged in a lower portion of the image-forming apparatus body 100 via a sheet feeding roller 27, a pair of registration rollers 28, and the like. More specifically, a plurality of sheets of the recording medium P, such as transfer paper, are contained and stacked in the sheet feeding unit 26. When the sheet feeding roller 27 is driven to rotate counterclockwise in FIG. 1, an uppermost sheet of the recording medium P is delivered to a nip between the pair of registration rollers 28.

The recording medium P conveyed to the pair of registration rollers 28 is temporarily stopped at the nip between the pair of registration rollers 28 which has stopped rotating. The pair of registration rollers 28 is driven to rotate to convey the recording medium P toward the secondary transfer nip at the right timing of the color image on the intermediate transfer belt 8. The desired color image is transferred onto the recording medium P.

Thereafter, the recording medium P onto which the color image has been transferred at the secondary transfer nip position is conveyed to a fixing device 20. The color image transferred onto the surface of the recording medium P is fixed onto the recording medium P by heat and pressure applied by a fixing belt and a pressure applying roller at this position. The recording medium P is discharged through a nip between a pair of sheet discharge rollers 29 out of the apparatus. Sheets of the recording medium P discharged by the pair of sheet discharge rollers 29 out of the apparatus are stacked, as output images, on a stacker unit 30 one sheet by one sheet. Thus, a series of image forming process performed by the image forming apparatus is completed.

A structure and operations of the developing device in the image formation unit are described below with reference to FIG. 2.

The developing device 5Y includes a developing roller 51Y which faces the photoconductive drum 1Y and serves as a developer bearer, a doctor blade 52Y which faces the developing roller 51Y and serves as a developer-layer leveling member, and two conveying screws 55Y which are arranged in developer containers 53Y and 54Y to serve as developer conveying members. The developing device 5Y includes a density sensor 56Y which detects a density of the toner in the developer. The developing roller 51Y includes a magnet fixedly and internally arranged on the developing roller 51Y and a developing sleeve which rotates around the magnet. A two-component developer G made up of carrier and the toner is stored in the developer containers 53Y and 54Y. The developer container 54Y has, at its top, an opening through which the developer container 54Y is in communication with a toner falling-and-conveying path 64Y.

Figure 3:
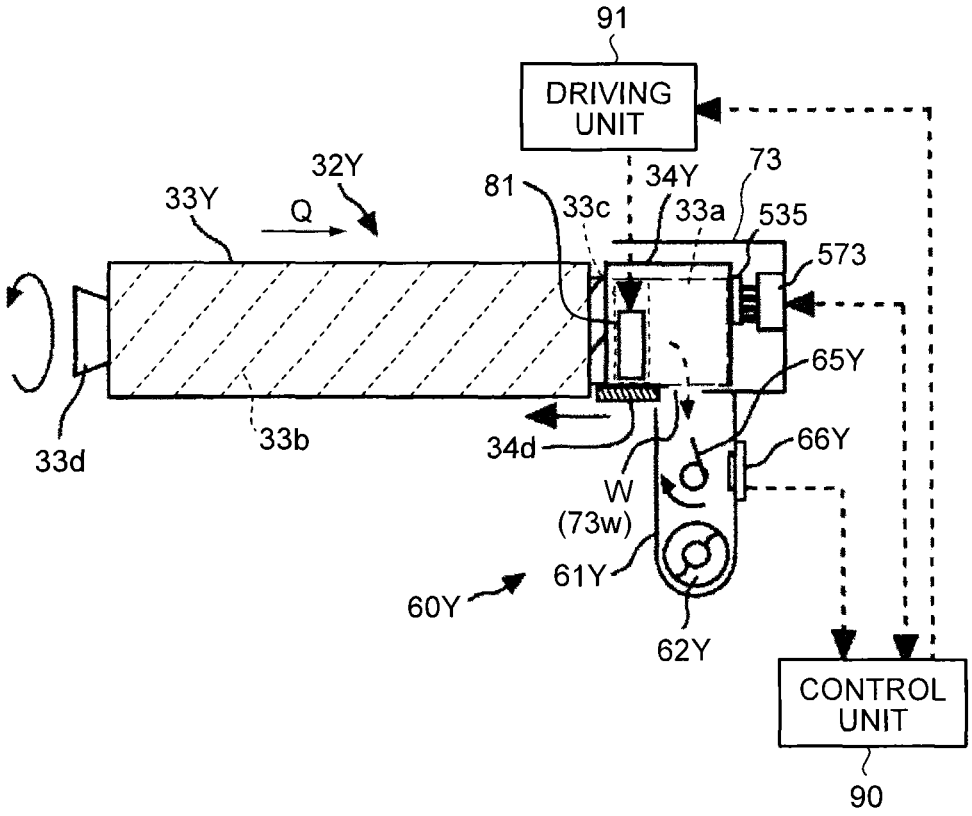
FIG. 3 is a schematic diagram illustrating a toner supply device, with a detachable device mounted thereon, of the image forming apparatus illustrated in FIG. 1.

The developing device 5Y configured in this manner operates as follows. The developing sleeve of the developing roller 51Y rotates in a direction indicated by an arrow in FIG. 2. The developer G is caused to stick to the developing roller 51Y by a magnetic field produced by the magnet and moves on the developing roller 51Y as the sleeve rotates. A ratio of toner (toner density) of the developer G in the developing device 5Y is adjusted so that the toner density falls within a predetermined range. More specifically, as the toner in the developing device 5Y is consumed, the toner stored in the toner container 32Y is supplied into the developer container 54Y through the toner supply device 60Y (as can be seen in FIG. 3, for example).

Thereafter, the toner supplied into the developer container 54Y circulates through the two developer containers denoted by 53Y and 54Y while being mixed and stirred together with the developer G by the two conveying screws 55Y (more specifically, the toner and the developer G move perpendicularly to the paper plane of FIG. 2). Frictional electrification between the toner and the carrier causes the toner in the developer G to cling to the carrier. The magnetic force produced on the developing roller 51Y causes the toner and the carrier to stick to the developing roller 51Y. The developer G sticking to the developing roller 51Y is conveyed in the direction indicated by the arrow in FIG. 2 to reach a position where the doctor blade 52Y is provided. At this position, the amount of the developer G on the developing roller 51Y is adjusted to an appropriate amount. Thereafter, the developer G is conveyed to a position (developing region) where the developer G faces the photoconductive drum 1Y. The toner is attracted to the latent image formed on the photoconductive drum 1Y by an electric field produced at the developing region. Thereafter, rotation of the sleeve brings the developer G left on the developing roller 51Y to an upper portion of the developer container 53Y. At this position, the developer G leaves the developing roller 51Y.

The toner supply devices 60Y, 60M, 60C, and 60K are described in detail below. The four toner supply devices denoted by 60Y, 60M, 60C, and 60K are substantially identical in structure except for the color of toner used in the image formation process. The same applies to the toner containers 32Y, 32M, 32C, and 32K. For this reason, only the toner supply device 60Y and the toner container 32Y for yellow are described below, and description about the toner supply devices 60M, 60C, and 60K and the toner containers 32M, 32C, and 32K for the other three colors are omitted as appropriate.

Referring to FIG. 1, toner is stored in the toner container 32Y mounted on the toner container housing 70 of the image-forming apparatus body 100. The toner is supplied into the developing device 5Y by the toner supply device 60Y as the toner in the developing device 5Y is consumed.

Referring to FIG. 1, when open, a body casing (not shown) mounted on a near side of the image-forming apparatus body 100 (the near side in the direction perpendicular to the paper plane of FIG. 1) uncovers the toner container housing 70 (more specifically, an insertion port unit 71). Attaching/detaching the toner container 32Y to/from the near side of the image-forming apparatus body 100 is performed with the longitudinal axis of the toner container 32Y laid horizontally. (Thus, the attaching/detaching is performed by moving the toner container in the longitudinal direction of the toner container.)

Figure 4:
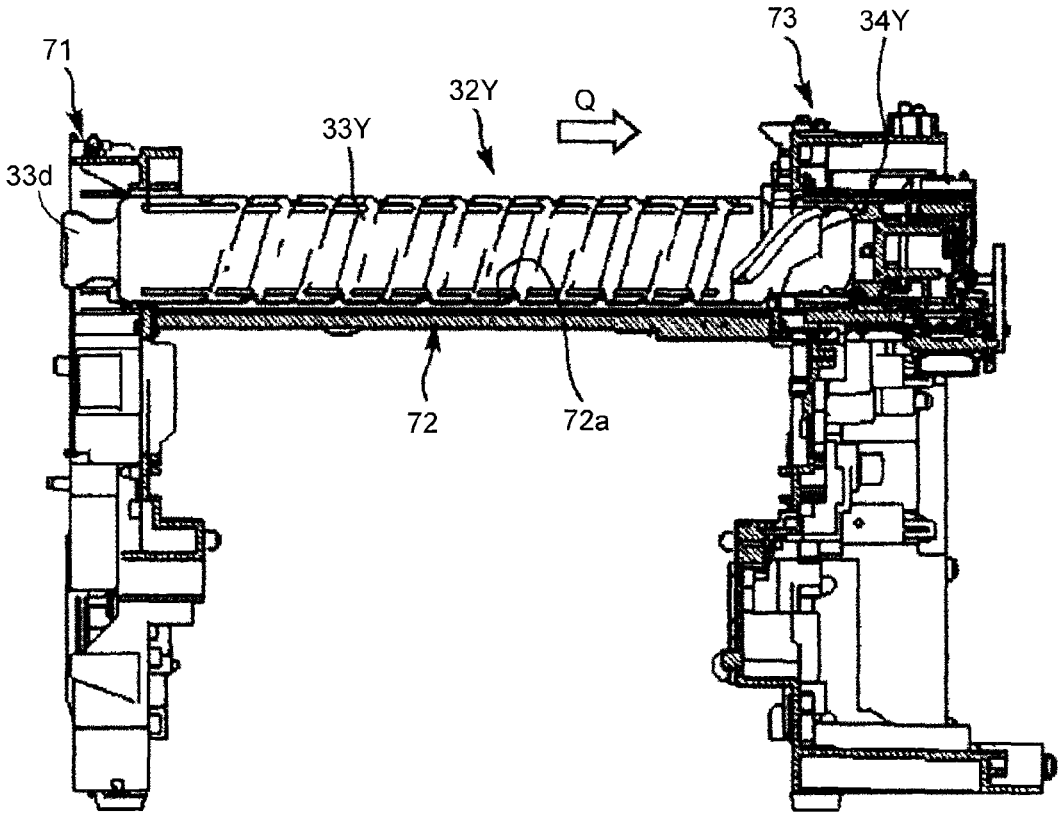
FIG. 4 is a side view of a toner container housing with the detachable device mounted thereon.

As illustrated in FIG. 4, when the toner container 32Y is attached to the toner container housing 70 of the image-forming apparatus body 100 (by being moved in a direction indicated by an arrow Q), a shutter member 34*d* of the toner container 32Y is moved interlocked with the attaching action as illustrated in FIG. 3. When the shutter member 34*d* is moved, the toner discharge port W (discharge port) is opened, and a toner supply port 73*w* and a toner discharge port W of the toner supply device 60Y are brought into communication with each other. As a result, the toner stored in the toner container 32Y is discharged through the toner discharge port W and stored through the toner supply port 73*w* in a toner tank unit 61Y of the toner supply device 60Y.

Referring to the schematic diagram illustrated in FIG. 3, the toner container 32Y is a substantially cylindrical toner bottle and includes a cap unit 34Y and a container body 33Y (bottle body). The cap unit 34Y is non-rotatably held by the toner container housing 70. A gear 33*c* is integrally formed with the container body 33Y on one end 33*a* of the container body 33Y. The container body 33Y is held rotatably in relation to the cap unit 34Y. The container body 33Y is driven to rotate by a driving unit 91 (made up of a drive motor, a drive gear 81, and the like) in a direction indicated by an arrow on the extreme left in FIG. 3. As the container body 33Y rotates, the toner stored inside the toner container 32Y (the container body 33Y) is conveyed toward the one end 33*a* by a projection 33*b* helically formed on an inner peripheral surface of the container body 33Y. In the example illustrated in FIG. 3, the toner is conveyed from the left side to the right side and discharged through the toner discharge port W provided in the cap unit 34Y. In short, the driving unit 91 appropriately drives the container body 33Y of the toner container 32Y to rotate, causing the toner to be supplied to the toner tank unit 61Y appropriately. When the toner container 32Y reaches an end of its usable life (i.e., when the toner container 32Y becomes empty because substantially all the toner stored therein is consumed), the toner container 32Y is to be replaced with a new one.

The configuration of the toner container 32Y is not limited to that described above in which the container body 33Y, where the helical projection 33*b* is formed, is driven to rotate, thereby discharging the toner inside the toner container 32Y through the toner discharge port W of the cap unit 34Y. Alternatively, the toner container 32Y may have the following configuration, for example. A screw or a like conveying member capable of rotating and conveying toner by its rotation is arranged inside the container body which has neither the helical projection 33*b* nor a groove. The driving unit 91 drives and rotates the conveying member, thereby discharging the toner inside the container body 33Y through the toner discharge port W of the cap unit 34Y.

Referring to FIG. 3, the toner supply device 60Y includes the toner container housing 70, the toner tank unit 61Y, a toner conveying screw 62Y, a stirring member 65Y, a toner end sensor 66Y, and the driving unit 91. The toner tank unit 61Y is arranged below the toner discharge port W of the toner container 32Y to store the toner discharged through the toner discharge port W of the toner container 32Y. Bottom of the toner tank unit 61Y is connected to an upstream portion of the toner conveying screw 62Y.

The toner end sensor 66Y for detecting that a level of the toner stored in the toner tank unit 61Y has become equal to or lower than a predetermined level is mounted on a wall surface of the toner tank unit 61Y (at a predetermined height above the bottom). A control unit 90 detects (makes toner end detection) that the toner end sensor 66Y has detected that the level of the toner stored in the toner tank unit 61Y has become equal to or lower than the predetermined level. When the toner end detection is made, the driving unit 91 (the drive gear 81) drives and rotates the container body 33Y of the toner container 32Y a predetermined period of time under control of the control unit 90, thereby supplying the toner to the toner tank unit 61Y. Furthermore, when the toner end sensor 66Y does not stop making the toner end detection even after such control as described above is repeatedly performed, it is determined that no toner is left in the toner container 32Y. In this case, a message prompting to replace the toner container 32Y is displayed on a display unit (not shown) of the image-forming apparatus body 100.

The stirring member 65Y is mounted at center (near the toner end sensor 66Y) of the toner tank unit 61Y to prevent aggregation of the toner stored in the toner tank unit 61Y. The stirring member 65Y which is made by mounting a flexible member on a shaft stirs the toner in the toner tank unit 61Y by rotating clockwise in FIG. 3. Furthermore, a distal end of the flexible member of the stirring member 65Y comes into sliding contact with a detection surface of the toner end sensor 66Y every rotation cycle thereof. This sliding contact alleviates a problem of degradation in detection accuracy which can result from toner sticking to the detection surface of the toner end sensor 66Y.

The toner conveying screw 62Y conveys the toner from the bottom (lowermost point) of the toner tank unit 61Y toward an upper portion of the developing device 5Y. The toner conveyed by the toner conveying screw 62Y falls through the toner falling-and-conveying path 64Y (as can be seen in FIG. 2) by its own weight to be supplied into the developing device 5Y (the developer container 54Y).

Referring to FIG. 4, the toner container housing 70 primarily includes a cap receptacle 73 which serves as a mount for holding the cap unit 34Y of the toner container 32Y. The toner container housing 70 includes a bottle receptacle 72 (container body receptacle) for holding the container body 33Y of the toner container 32Y, and the insertion port unit 71 serving as an insertion port where the toner container 32Y is to be inserted when the toner container 32Y is attached to the toner container housing 70.

The toner container housing 70 (the bottle receptacles 72 and the cap receptacles 73) is described in detail below. The toner container housing 70 includes the insertion port units 71, the bottle receptacles 72, and the cap receptacles 73 that are provided for each of the colors. Bottle receiving surfaces 72*a* and the cap receptacles 73 are formed on the bottle receptacles 72 for each of the colors. Each of the toner containers is inserted into one of the bottle receiving surfaces 72*a* and one of the cap receptacles 73 of the corresponding color. FIG. 4 illustrates only the toner container 32Y for yellow. The cap receptacles 73 are non-rotatably held by the bottle receptacles 72 at positions where the toner containers are inserted. Each of the cap receptacles 73 rotatably supports the cap units 34Y of the inserted toner container 32Y. The bottle receiving surface 72*a* functions as a sliding surface of the toner container 32Y during attachment/detachment of the toner container 32Y. After the toner container 32Y has been attached, the bottle receiving surface 72*a* functions as a holder of the container body 33Y which is to be driven to rotate.

Referring to FIG. 4, the toner container 32Y is mounted by a user gripping a grip unit 33*d*. More specifically, the toner container 32Y is attached in an attaching orientation where the longitudinal axis of the toner container 32Y laid horizontally and in such a manner that the cap unit 34Y is inserted first into the toner container housing 70 through the insertion port unit 71. The toner container 32Y inserted through the insertion port unit 71 is pushed by the user toward the cap receptacle 73 while sliding on the bottle receiving surface 72*a* of the bottle receptacle 72. Eventually, the toner container 32Y is rotatably supported by the cap receptacle 73 for yellow.

As illustrated in FIG. 3, an IC chip 535 serving as an information storage device is arranged at a distal end of the cap unit 34Y of the toner container 32Y. A communication connector 573 which communicates information with the IC chip 535 is arranged on the cap receptacle 73 (the image-forming apparatus body 100) facing the IC chip 535. The communication connector 573 is connected to the control unit 90 via a signal line. When the toner container 32Y is attached to the toner container housing 70, the communication connector 573 contacts the IC chip 535 and makes information communication with the IC chip 535 possible. The IC chips 535 are arranged on the cap receptacles of the toner containers for the other colors than yellow, respectively, and the communication connectors 573 which communicate information with the IC chips 535 are arranged on the cap receptacles 73 (the image-forming apparatus body 100) facing the IC chips 535, respectively.

Figure 5:
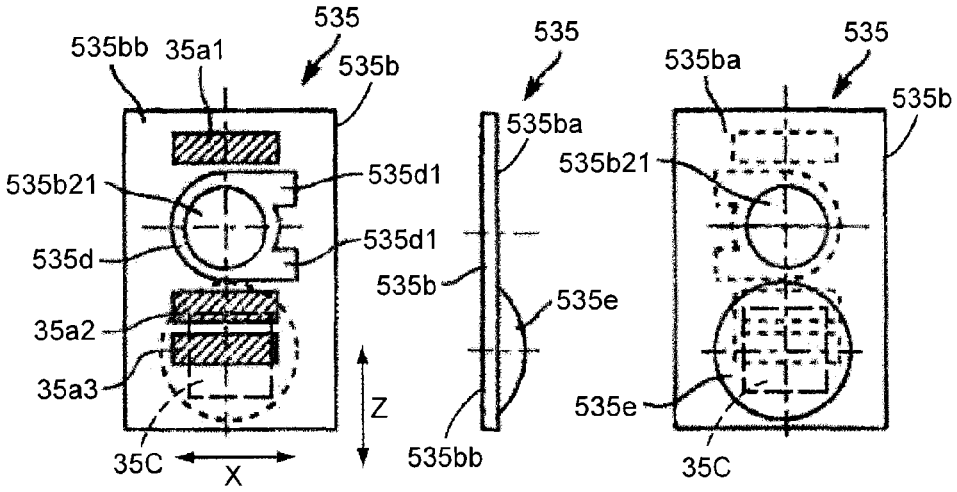
FIG. 5 is a three view diagram illustrating a structure of an information storage device.

As illustrated in the three view diagram of FIG. 5, the IC chip 535 has a positioning hole 535*b*21 passing through a substrate 535*b* at a position vertically above the center of gravity of the substrate 535*b* to serve as a guide portion. A grounding metal terminal 535*d* serving as a contact terminal inside the guide portion is mounted on an inner periphery of and around the hole 535*b*21. The portion of the metal terminal 535*d* formed around the hole 535*b*21 is referred to as the "annular portion". The metal terminal 535*d* formed on a front surface 535*bb*, at which the substrate 535*b* is to contact a body terminal 573*e*2 illustrated in FIG. 6, of the substrate 535*b* includes two extending portions 535*d*1 which extend horizontally from the annular portion. A rectangular metal pad 35*a*1 serving as a contact terminal is mounted on the IC chip 535 at a position vertically above the positioning hole 535*b*21. Two rectangular metal pads denoted by 35*a*2 and 35*a*3 serving as contact terminals are mounted on the IC chip 535 at positions vertically below the positioning hole 535*b*21.

A hemispherical protection member 535*e* made of resin such as epoxy is arranged on a back surface 535*ba* (the surface on the opposite side of the surface 535*bb*) of the substrate 535*b* to protect an information storage unit 35C by covering the same. In this example, the protection member 535*e* internally contains the information storage unit 35C, such as an IC. However, the manner the protection member 535*e* protects the information storage unit 35C can vary depending on the shape of the substrate 535*b*, and the structure and/or layout of a back surface of the protection member 535*e*. To take this into consideration, the hole 535*b*21 is arranged above the protection member 535*e* which is largest and heaviest among components on the back surface 535*ba*. This is the reason why the positional relationship that the hole 535*b*21 is vertically above the center of gravity of the IC chip 535 are realized. The back surface 535*ba* of the substrate 535*b* faces a second facing member 534*k*25 of a holding member 534*k*, which serves as a holding unit, illustrated in FIG. 6.

Figure 6:
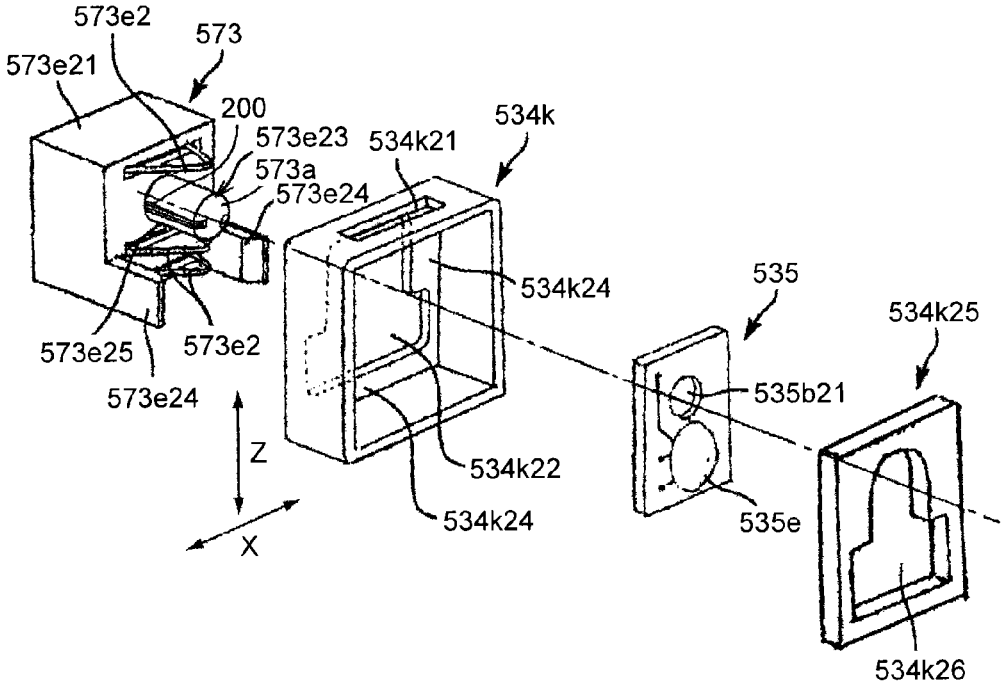
FIG. 6 is an exploded perspective view illustrating a structure of the information storage device, a holding member, and a communication connector.

As illustrated in FIG. 6, the communication connector 573 includes a connector body 573*e*21 which is a hollow box made of resin. The connector body 573*e*21 includes, as a projection on the side of the image-forming apparatus body (hereinafter, "body projection"), a positioning pin 573*e*23 extending in the direction in which the toner container 32Y moves and having a tapered end portion 573*a* (formed as a slope). The positioning pin 573*e*23 having a hollow cylindrical shape is arranged to stand in the horizontal direction in which the toner container 32Y moves. The positioning pin 573*e*23 is configured to be insertable into the hole 535*b*21 of the IC chip 535 which moves. A grounding body terminal 573*e*25 (earth terminal) is mounted on the positioning pin 573*e*23. The communication connector 573 includes a piece of the body terminal 573*e*2 at a position vertically above the positioning pin 573*e*23 (the grounding body terminal 573*e*25) and two pieces of the body terminal 573*e*2 at positions vertically below the positioning pin 573*e*23. Each of the body terminals 573*e*2 is a metal plate (or wire) member and allows information communication with the IC chip 535 when coming in contact with the metal pad 35*a*1 and the metal pads 35*a*2 and 35*a*3 of the IC chip 535.

Runout preventing members 573*e*24 are arranged in a lower portion of the connector body 573*e*21 on both sides of the positioning pin 573*e*23. Each of the runout preventing members 573*e*24 includes a rib. The pair of ribs has, on inner sides at their distal ends, tapered surfaces having line symmetry. The runout preventing members 573*e*24 function as guiding members which face at both side end faces of the IC chip 535 at positions vertically lower than the center of the hole 535*b*21.

The holding member 534*k* serving as the holding unit is fixed to the toner container 32Y and located between the communication connector 573 and the IC chip 535. The holding member 534*k* has a function of holding the IC chip 535 thereinside in a manner that allows the IC chip 535 to move on an XZ plane. The holding member 534*k* includes a first facing portion 534*k*24 having line symmetry with respect to a vertical axis of the holding member 534*k*. The holding member 534*k* is formed so as to cover an area, which extends from two upper end corners of the IC chip 535 to both sides of the hole 535*b*21 of the IC chip 535. Furthermore, the holding member 534*k* is formed so as to cover a portion lower than the lowermost metal pad 35*a*3 of the substrate 535*b*. This structure of the holding member 534*k* prevents the IC chip 535 from falling off from the holding member 534*k*.

A large portion, including areas facing the body terminals 573*e*2 and 573*e*25 of the communication connector 573, of the first facing portion 534*k*24 of the holding member 534*k* is open. More specifically, the holding member 534*k* has an inversed "T" shaped opening 534*k*22 extending to contain portions corresponding to the pair of the runout preventing members 573*e*24. During attachment of the toner container 32Y, after the positioning pin 573*e*23 has entered inside the opening 534*k*22, the runout preventing members 573*e*24 enters inside the holding member 534*k* through the opening 534*k*22.

The plate-like second facing member 534*k*25 facing the back surface 535*ba* of the IC chip 535 and serving as the holding unit is fixed onto the holding member 534*k* with an adhesive, by a snap-fit attachment (not shown), or a like method. The second facing member 534*k*25 includes, as does the first facing portion 534*k*24, an inversed "T" shaped opening 534*k*26 which allows avoiding interference with the protection member 535*e* or the runout preventing members 573*e*24 advancing into the holding member 534*k*. Meanwhile, the IC chip 535 is pushed when the positioning pin 573*e*23 is inserted into the hole 535*b*21 of the IC chip 535. However, because the second facing member 534*k*25 supports the substrate 535*b* from behind, the contact state between the terminals is maintained.

In short, in the embodiment, the hole 535*b*21 is movable on an imaginary plane intersecting a moving direction, in which the toner container 32Y attached to the image-forming apparatus body 100 moves toward the communication connector 573.

Figure 7:
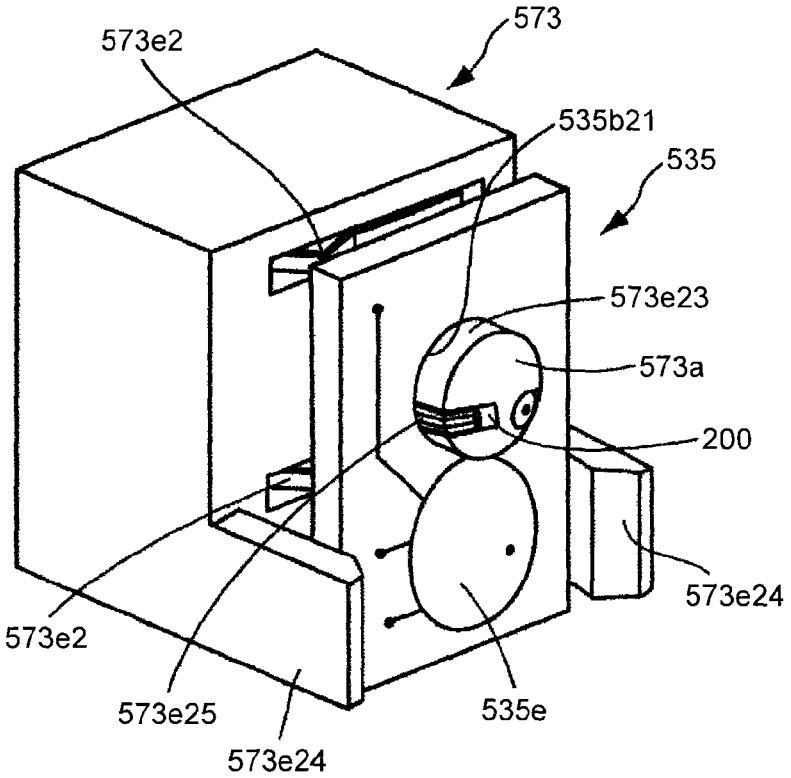
FIG. 7 is an enlarged perspective view illustrating the information storage device and the communication connector in a contact state.
Figure 8:
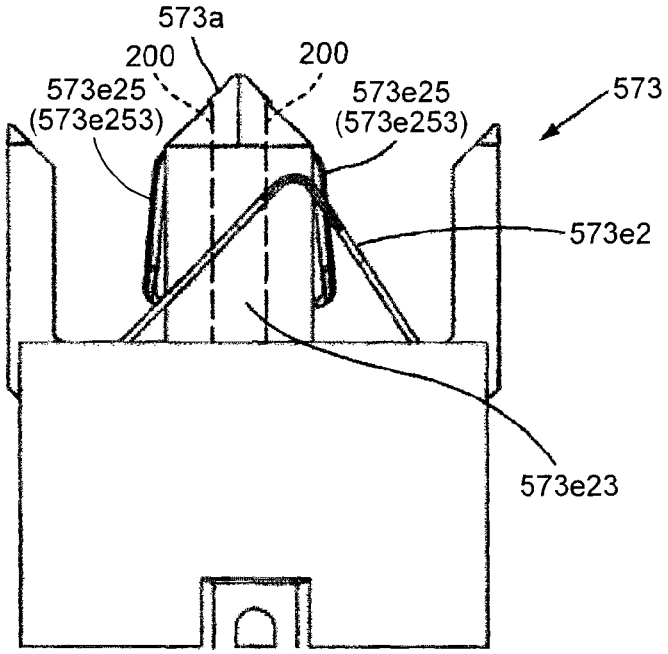
FIG. 8 is an enlarged diagram illustrating a structural overview of the communication connector which is a primary element of the present invention.
Figure 9:
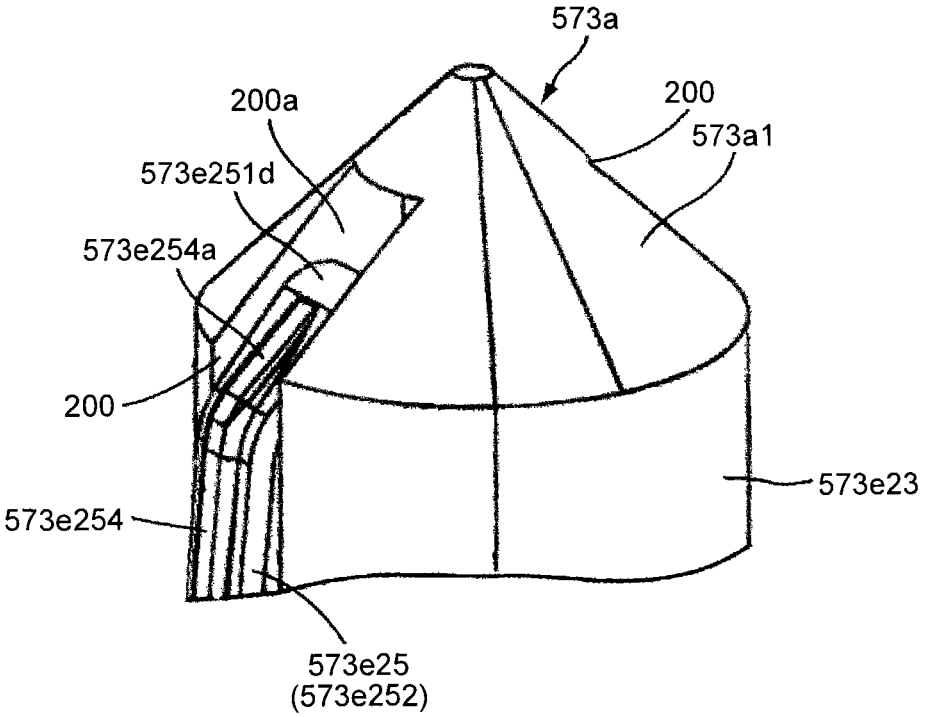
FIG. 9 is a partially enlarged diagram illustrating a structure of a distal end of a body projection of the communication connector.

As illustrated in FIGS. 6 and 7, the grounding body terminal 573*e*25 is exposed through slit-like openings 200 and 200 formed on the surface of the positioning pin 573*e*23 and projects out from the positioning pin 573*e*23. The body terminal 573*e*25 is the metal plate (or wire) member a portion of which is housed in a hollow of the positioning pin 573*e*23 that is integrally formed with the connector body 573*e*21.

When the toner container 32Y configured as described above is attached to the image-forming apparatus body 100, the cap unit 34Y is inserted into the cap receptacle 73. During this insertion, as illustrated in FIG. 7, the hole 535*b*21 of the IC chip 535 is guided by the positioning pin 573*e*23 in a manner to slide along a slope 573*a*1 of the end portion 573*a* which is at a distal end of the positioning pin 573*e*23 of the communication connector 573. Positioning of the IC chip 535 is hence completed. At this time, a portion (portion corresponding to an inner periphery of the hole 535*b*21) of the earth terminal 535*d* of the IC chip 535 is brought into contact with the grounding body terminal 573*e*25 of the positioning pin 573*e*23, thereby establishing a ground (continuity) for the IC chip 535. After the ground is established, the three metal pads 35*a* (35*a*1, 35*a*2, and 35*a*3) of the IC chip 535 are also brought into contact with the three body terminals 573*e*2 of the communication connector 573, respectively. Accordingly, transmitting information between the IC chip 535 and the communication connector 573 (the image-forming apparatus body 100) becomes possible.

However, there is a disadvantage in the configuration described above in which the holding member 534*k* holds the IC chip 535 in the manner that allows the IC chip 535 to move on the imaginary plane intersecting the moving direction in which the toner container 32 moves toward the body terminal 573*e*25 to bring the terminals into contact with each other while performing positioning by inserting the positioning pin 573*e*23 of the communication connector 573 into the hole 535*b*21 of the IC chip 535.

The disadvantage is described below. If the body terminal 573*e*25 projects further than the end portion 573*a* which is conical (i.e., having the slope 573*a*1) of the positioning pin 573*e*23, the body terminal 573*e*25 can contact and be pushed by the hole 535*b*21 of the IC chip 535 when the body terminal 573*e*25 moves with the hole 535*b*21 guided by the positioning pin 573*e*23. This can undesirably result in deformation of the body terminal 573*e*25. Such deformation of the body terminal 573*e*25 can be a cause of a contact failure at contacts where the body terminal 573*e*25 contacts the IC chip or breakage of the body terminal 573*e*25, which can be a cause of a communication error.

Figure 10:
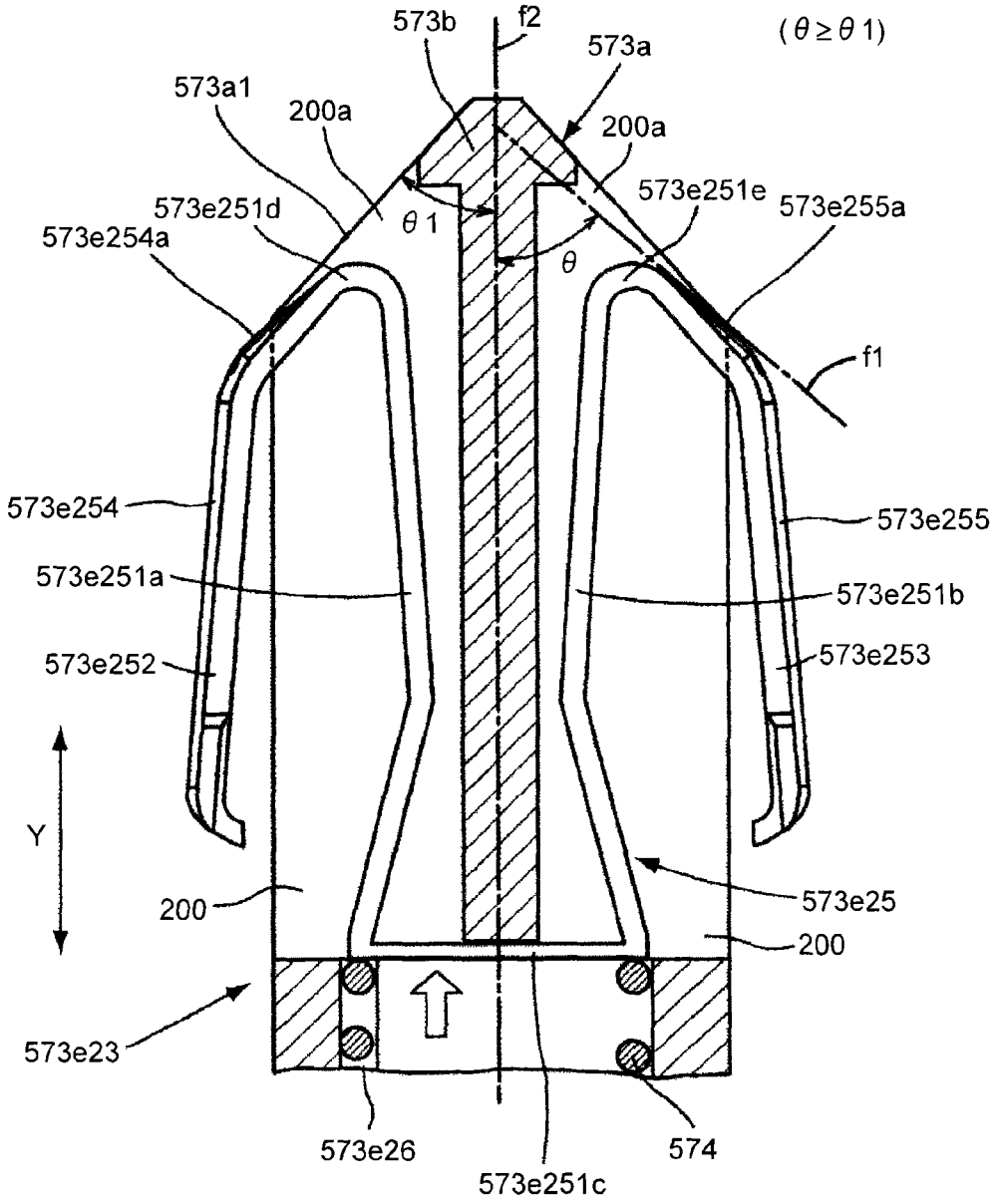
FIG. 10 is an enlarged cross-sectional diagram illustrating an internal structure of the communication connector and a structure of a body terminal.

Under the circumstances, the embodiment employs the configuration in which the body terminal 573*e*25 does not project further than the end portion 573*a* of the positioning pin 573*e*23. FIG. 10 is a cross-sectional diagram illustrating an internal structure of the positioning pin 573*e*23. The positioning pin 573*e*23 is open at one end and includes the end portion 573*a* at the other end. The end portion 573*a* is conical in shape and has the surface formed as the slope 573*a*1. The positioning pin 573*e*23 has the slit-like openings 200 and 200 extending in a longitudinal direction Y of the positioning pin 573*e*23. The openings 200 and 200 are arranged so as to face each other and have end portions 200*a* and 200*a* extending as far as to the end portion 573*a* in a manner to cut out the slope.

Figure 11:
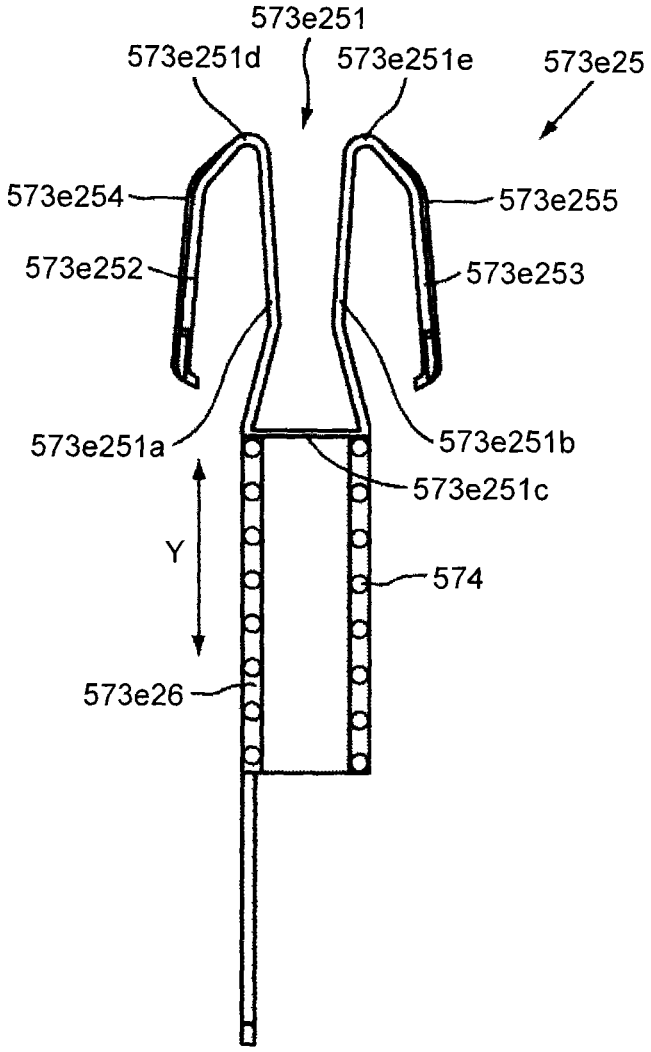
FIG. 11 is an enlarged diagram illustrating the structure of the body terminal mounted on the communication connector.

The body terminal 573*e*25 includes a body portion 573*e*251 and contact arms 573*e*252 and 573*e*253 as illustrated in FIGS. 10 and 11. The body portion 573*e*251 is formed in a substantially U-shape having mutually-facing support portions 573*e*251*a* and 573*e*251*b* by bending opposite sides of a seat portion 573*e*251*c* of the body portion 573*e*251 in a same direction. The contact arms 573*e*252 and 573*e*253 are formed by further outwardly bending the support portions 573*e*251*a* and 573*e*251*b* at their end portions 573*e*251*d* and 573*e*251*e*. The contact arms 573*e*252 and 573*e*253 are configured so that, when the body terminal 573*e*25 is attached to the positioning pin 573*e*23, only the contact arms 573*e*252 and 573*e*253 project out from the surface of the positioning pin 573*e*23. A conducting portion 573*e*26 extending in the longitudinal direction Y is formed on the seat portion 573*e*251*c*.

As illustrated in FIG. 10, drawn portions 573*e*254 and 573*e*255 which are to be brought into contact with the earth terminal 535*d* inside the hole 535*b*21 of the IC chip 535 are formed at centers of the contact arms 573*e*252 and 573*e*253, respectively. One ends 573*e*254*a* and 573*e*255*a* of the drawn portions 573*e*254 and 573*e*255 are formed as gentle slopes extending toward the end portions 573*e*251*d* and 573*e*251*e*, respectively. The drawn portions 573*e*254 and 573*e*255 are formed to prevent an undesirable situation that would otherwise occur if the body terminal 573*e*25 is formed of a metal plate member. More specifically, if the body terminal 573*e*25 should be formed of a metal plate member, an edge of the body terminal 573*e*25 can contact and undesirably shave the earth terminal 535*d* on the inner periphery of the hole 535*b*21. For this reason, the drawn portions 573*e*254 and 573*e*255 are formed by a drawing process so as to outwardly protrude in an arc from the contact arms 573*e*252 and 573*e*253.

Meanwhile, the contact arms 573*e*252 and 573*e*253 contact the earth terminal 535*d* inside the hole 535*b*21 of the IC chip 535 at the drawn portions 573*e*254 and 573*e*255. Accordingly, if a method of simply moving the positions where the drawn portions 573*e*254 and 573*e*255 are formed to positions lower than the distal end 573*a* is employed, contact positions between the earth terminal 535*d*, and the drawn portions 573*e*254 and 573*e*255 are undesirably displaced. It is undesirable to displace the contact positions (contact timing). This is because the contact positions depend not only on the relationship between the earth terminal 535*d*, and the drawn portions 573*e*254 and 573*e*255 but also depend on an attached state of the toner container 32Y.

In the embodiment, the positions of the drawn portions 573*e*254 and 573*e*255 remain unchanged; instead, the end portions 573*e*251*d* and 573*e*251*e* of the contact arms 573*e*252 and 573*e*253 are formed so as not to project further than the tapered end portion 573*a* of the positioning pin 573*e*23. To this end, each of the drawn portions 573*e*254 and 573*e*255 is formed so as to satisfy θΓθ1, where θ is an end-portion inclination angle of the end portion 573*e*254*a*, 573*e*255*a* of the drawn portion 573*e*254, 573*e*255 on the side of the slope 573*a*1, and θ1 is an inclination angle of the slope 573*a*1 of the end portion 573*a* of the positioning pin 573*e*23. In short, the body terminal 573*e*25 is arranged on the positioning pin 573*e*23 and configured not to project further than the slope of the end portion 573*a*, to be exposed to the outside from a portion other than the slope, and to be brought into contact with the metal terminal 535*d* mounted inside the hole 535*b*21 when the positioning pin 573*e*23 is inserted into the hole 535*b*21. The body terminal 573*e*25 is formed so as to satisfy θ≥θ1, where θ is the end-portion inclination angle of the end portion 573*e*254*a*, 573*e*255*a* which is the end portion of the body terminal 573*e*25 on the side of the slope 573*a*1, and θ1 is the inclination angle of the slope 573*a*1 of the end portion 573*a*. The end-portion inclination angle θ may also be referred to as the terminal inclination angle θ.

The end-portion inclination angle θ is an angle between a tangent f1 extending through the end portion 573*e*254*a*, 573*e*255*a* of the drawn portion 573*e*254, 573*e*255 on the side of the slope 573*a*1 and a center line f2 of the positioning pin 573*e*23. The inclination angle θ1 is an angle between the slope 573*a*1 and the center line f2.

Figure 12:
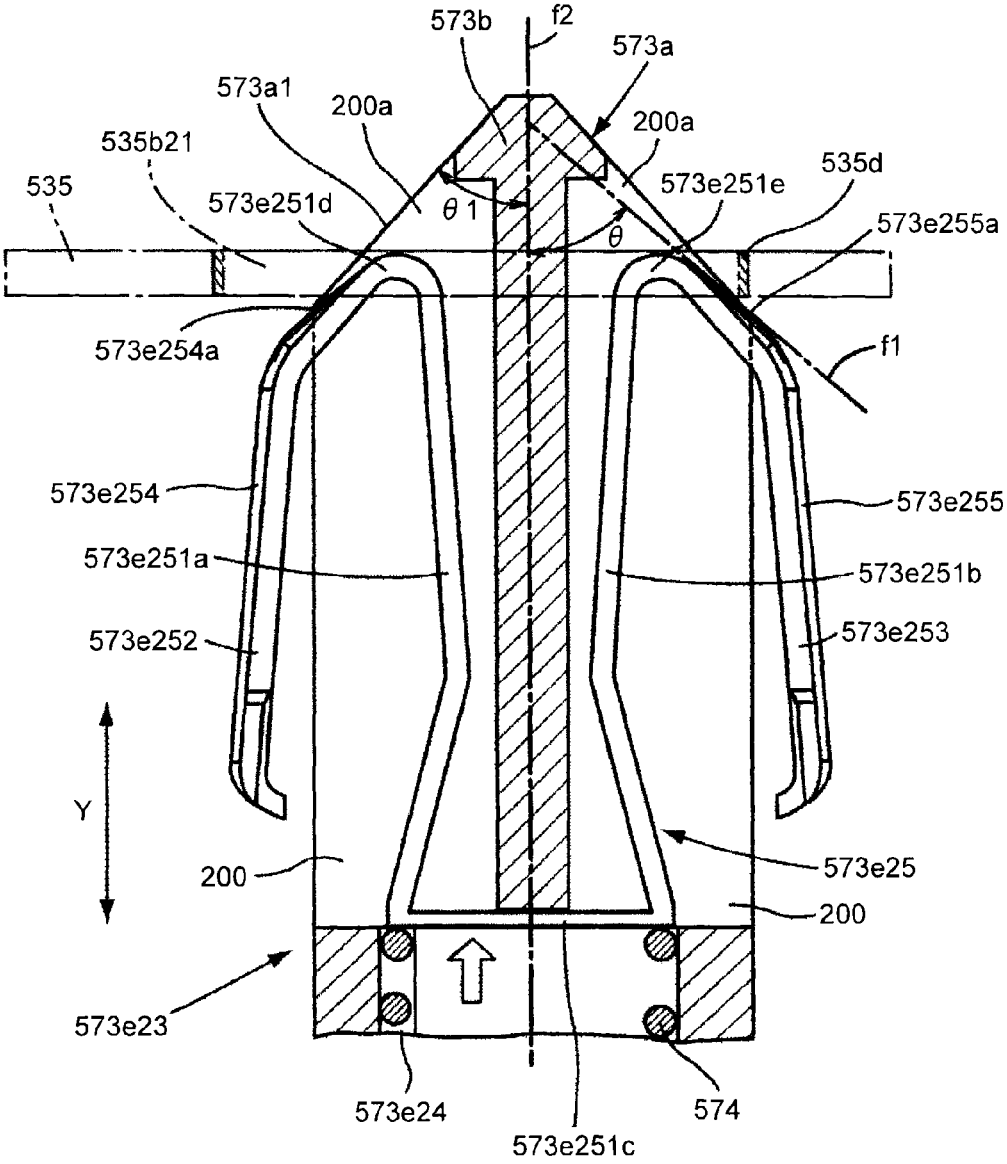
FIG. 12 is an enlarged diagram illustrating a state in which a guide portion of the information storage device is inserted into the distal end of the body projection of the communication connector.
Figure 13:
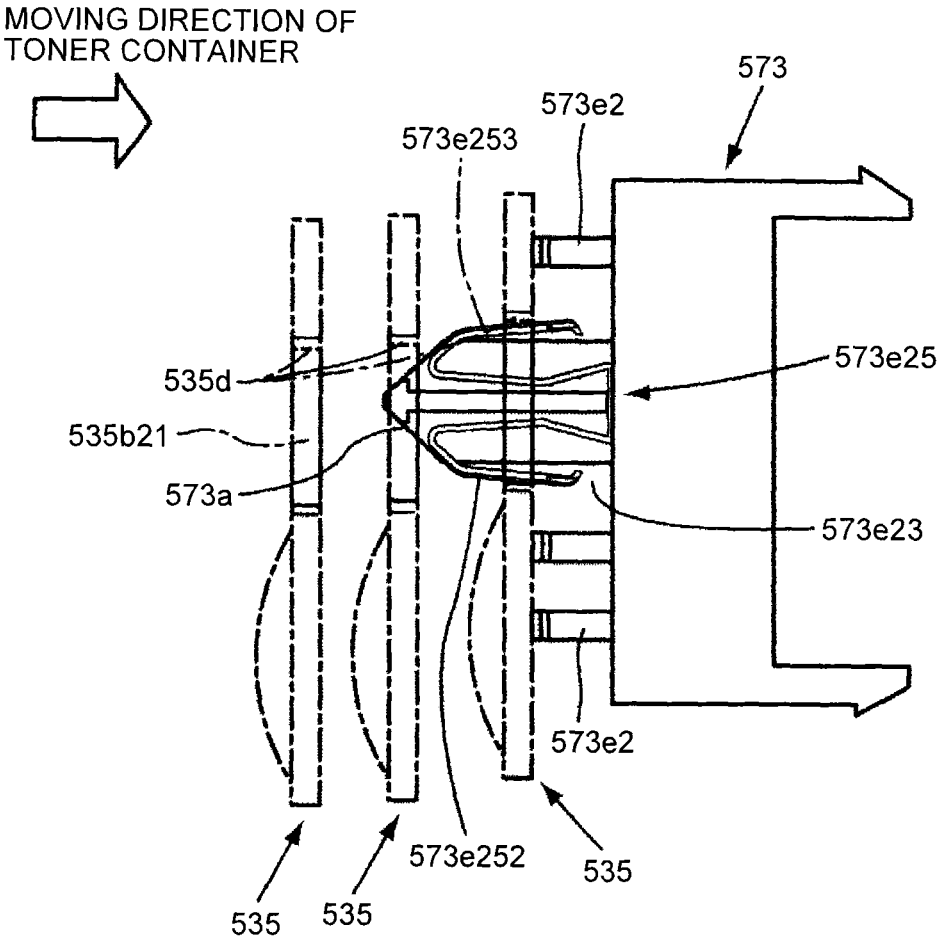
FIG. 13 is a movement diagram illustrating how the information storage device is inserted into the communication connector.

The configuration described above allows preventing the drawn portions 573*e*254 and 573*e*255 of the contact arms 573*e*252 and 573*e*253 from being caught by the earth terminal 535*d* of the IC chip 535 during insertion of the positioning pin 573*e*23 into the hole 535*b*21 of the IC chip 535 as illustrated in FIGS. 12 and 13. As a result, a problem of deformation (buckling) of the contact arms 573*e*252 and 573*e*253 can be prevented, and therefore a stable communication state with neither contact failure nor communication error can be attained.

As illustrated in FIG. 10, when the body terminal 573*e*25 is inserted into the positioning pin 573*e*23 from the one end that is open, the contact arms 573*e*252 and 573*e*253 project to the outside of the positioning pin 573*e*23 through the openings 200 and 200. During insertion of the body terminal 573*e*25, the seat portion 573*e*251*c* of the body terminal 573*e*25 is brought into abutment on a bottom portion of a core portion 573*b* of the positioning pin 573*e*23 formed between the openings 200 and 200. How far the contact arms 573*e*252 and 573*e*253 project from the opening 200 and 200 is defined in this manner. The seat portion 573*e*251*c* on the side opposite from the core portion 573*b* is urged by a coil spring 574, which serves as an urging unit, to project toward the end portion 573*a* of the positioning pin 573*e*23. Accordingly, the body terminal 573*e*25 is held to be movable (capable of moving forward and backward) in the longitudinal direction Y relative to the positioning pin 573*e*23.

With this configuration, even when the drawn portions 573*e*254 and 573*e*255 which are the distal ends of the body terminal 573*e*25 should project from the slope (the end portion 573*a*) of the positioning pin 573*e*23 due to deformation (buckling) of the body terminal 573*e*25, or a processing failure such as variation in a position where the body terminal 573*e*25 is inserted, of the body terminal 573*e*25, the drawn portion 573*e*254, 573*e*255 abuts on an edge of the hole 535*b*2 of the IC chip 535. As a result, the drawn portions 573*e*254 and 573*e*255 are pushed further inside the positioning pin 573*e*23 than the distal end 573*a* of the positioning pin 573*e*23. Accordingly, buckling of the contact arms 573*e*252 and 573*e*253 (the drawn portions 573*e*254 and 573*e*255) can be prevented while maintaining the contact position between the IC chip 535 and the earth terminal 535*d* unchanged. Therefore, a stable communication state with neither contact failure nor communication error can be attained.

According to an aspect of the present invention, a communication connector includes a body terminal mounted on a body projection which has a slope at its end portion. The body terminal to be brought into contact with a contact terminal mounted inside a guide portion of an information storage device is configured to satisfy the following relationship: θ≥θ1, where θ is an end-portion inclination angle of the end portion of the body terminal on a side of the slope and θ1 is an inclination angle of the slope. Because the end portion of the body terminal is prevented from projecting out from the slope, deformation of the body terminal which would otherwise occur when a substrate of an information storage device moves with its guide portion guided by the body terminal is prevented. Consequently, a stable communication state with neither contact failure nor communication error can be attained.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A communication connector for use with an image-forming apparatus body to make communications with an information storage device including a guide portion and installed on a detachable device possible, the communication connector comprising:

a body terminal configured to, when the detachable device is attached to the image-forming apparatus body, contact a contact terminal of the information storage device; and a body projection extending in a moving direction of the detachable device, having a distal end formed as a conical surface, and being insertable into the guide portion, the body projection having a central axis extending in the moving direction wherein the body terminal is mounted on the body projection and disposed not to project further than the conical surface, to be exposed to outside from a portion other than the conical surface, and to contact the contact terminal mounted inside the guide portion when the body projection is inserted into the guide portion, the body terminal having two contact surfaces which are on different sides of the central axis of the body projection, and the body terminal is configured to satisfy following relationship: θ≥θ1, where θ is an angle between a tangent extending through an end portion of the body terminal on a side of the conical surface and a center line of the body projection and f1 is an angle between the conical surface and the center line.

2. The communication connector according to claim 1, wherein the body terminal includes a drawn portion protruding outward, and the end-portion inclination angle θ is an angle between a tangent extending through an end portion of the drawn portion on the side of the conical surface and a center line of the body projection.

3. The communication connector according to claim 1, wherein the body projection is inserted into the guide portion, the guide portion being movable on an imaginary plane intersecting a moving direction in which the detachable device attached to the image-forming apparatus body moves toward the communication connector.

4. A toner supply device comprising the communication connector according to claim 1.

5. An image forming apparatus comprising the toner supply device according to claim 4.

6. An image forming apparatus comprising the communication connector according to claim 1.

7. A communication connector for use with an image-forming apparatus body to make communications with an information storage device including a guide portion and installed on a detachable device possible, the communication connector comprising:

a body terminal to, when the detachable device is attached to the image-forming apparatus body, contact a contact terminal of the information storage device; and a body projection extending in a moving direction of the detachable device, having a conical distal end, and being insertable into the guide portion, the body projection having a central axis extending in the moving direction, wherein the body terminal is mounted on the body projection and disposed not to project further than the conical surface, to be exposed to outside from a portion other than the conical surface, and to contact the contact terminal mounted inside the guide portion when the body projection is inserted into the guide portion, the body terminal having two contact surfaces which are on different sides of the central axis of the body projection.

8. A toner supply device comprising the communication connector according to claim 7.

9. An image forming apparatus comprising the toner supply device according to claim 8.

10. An image forming apparatus comprising the communication connector according to claim 7.

11. A communication connector, comprising:

a body projection including a slope at an end thereof, the slope inclining relative to a central axis of the body projection; and a body terminal, connected to the body projection, to contact a contact terminal of an information storage device, including two first contact surfaces on opposite sides of the central axis of the body projection, and two second contact surfaces, connected to corresponding ones of the two first contact surfaces, on opposite sides of the central axis of the body projection, wherein $\theta \geq \theta 1$, where $\theta$is an angle between one of the first contact surfaces and the central axis, and $\theta 1$ is an angle between the slope of the body projection and the central axis.

12. The communication connector according to claim 11, wherein:

the two first contact surfaces do not project further than the slope of the body projection.

13. The communication connector according to claim 11, wherein:

the body terminal protrudes outwardly away from the central axis.

14. An image forming apparatus comprising the communication connector according to claim 11.

* * * * *